US010884366B2

(12) United States Patent
Seki

(10) Patent No.: US 10,884,366 B2
(45) Date of Patent: Jan. 5, 2021

(54) HEATER, FIXING DEVICE, AND IMAGE FORMING APPARATUS

(71) Applicant: Takayuki Seki, Kanagawa (JP)

(72) Inventor: Takayuki Seki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/777,938

(22) Filed: Jan. 31, 2020

(65) Prior Publication Data

US 2020/0285179 A1 Sep. 10, 2020

(30) Foreign Application Priority Data

Mar. 8, 2019 (JP) ..... 2019-042179

(51) Int. Cl.
*G03G 15/20* (2006.01)

(52) U.S. Cl.
CPC ..... *G03G 15/2053* (2013.01); *G03G 15/2064* (2013.01); *G03G 2215/2035* (2013.01)

(58) Field of Classification Search
CPC ..... G03G 15/2017; G03G 15/2053; G03G 15/2064; G03G 2215/2003; G03G 2215/2035
See application file for complete search history.

(56) References Cited

U.S. PATENT DOCUMENTS

| | | | |
|---|---|---|---|
| 2014/0079455 | A1 | 3/2014 | Seki et al. |
| 2014/0270833 | A1 | 9/2014 | Yuasa et al. |
| 2015/0055994 | A1 | 2/2015 | Shoji et al. |
| 2015/0110531 | A1 | 4/2015 | Takagi et al. |
| 2015/0125193 | A1 | 5/2015 | Ishii et al. |
| 2016/0161890 | A1 | 6/2016 | Shoji et al. |
| 2016/0274511 | A1 | 9/2016 | Ogino et al. |
| 2017/0185020 | A1 | 6/2017 | Seki et al. |
| 2017/0185021 | A1 | 6/2017 | Seki et al. |
| 2017/0255147 | A1 | 9/2017 | Seki et al. |
| 2017/0364000 | A1 | 12/2017 | Seki et al. |
| 2018/0157198 | A1 | 6/2018 | Seto et al. |
| 2018/0173138 | A1 | 6/2018 | Seki et al. |

FOREIGN PATENT DOCUMENTS

| | | |
|---|---|---|
| JP | 11-052767 | 2/1999 |
| JP | 2001-223068 | 8/2001 |
| JP | 2001-324886 | 11/2001 |
| JP | 2007-025133 | 2/2007 |
| JP | 2016-173457 | 9/2016 |
| JP | 2016-177136 | 10/2016 |

OTHER PUBLICATIONS

JP 2001324886 English machine translation, Nimura et al., Nov. 22, 2001 (Year: 2001).*

* cited by examiner

*Primary Examiner* — Thomas S Giampaolo, II
(74) *Attorney, Agent, or Firm* — Xsensus LLP

(57) ABSTRACT

A heater is installable in a fixing device having a fixing nip through which a recording medium is conveyed. The heater includes a base including a downstream portion in a recording medium conveyance direction. A heat generator is mounted on the base. A projection is disposed separately from the base and shifted from the heat generator. The projection is disposed opposite the downstream portion of the base. The projection projects toward the fixing nip in a state in which the heater is installed in the fixing device.

16 Claims, 14 Drawing Sheets

HEATER, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2019-042179, filed on Mar. 8, 2019, in the Japan Patent Office, the entire disclosure of which is hereby incorporated by reference herein.

BACKGROUND

Technical Field

Exemplary aspects of the present disclosure relate to a heater, a fixing device, and an image forming apparatus.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses include a fixing device including a fixing belt serving as a fixing member or a fixing rotator and a heater that heats the fixing belt. The heater heats the fixing belt to a fixing temperature. Thereafter, while a recording medium such as a sheet is conveyed through a fixing nip formed between the fixing belt and a pressure roller, the fixing belt and the pressure roller fix an unfixed toner image on the recording medium under heat and pressure at the fixing nip.

A projection that projects toward the pressure roller is disposed at an exit of the fixing nip or disposed downstream from the fixing nip in a recording medium conveyance direction. The projection improves fixing of the toner image on the recording medium at a position downstream from the fixing nip in the recording medium conveyance direction and facilitates separation of the recording medium from the fixing belt after fixing of the toner image on the recording medium.

SUMMARY

This specification describes below an improved heater installable in a fixing device having a fixing nip through which a recording medium is conveyed. In one embodiment, the heater includes a base including a downstream portion in a recording medium conveyance direction. A heat generator is mounted on the base. A projection is disposed separately from the base and shifted from the heat generator. The projection is disposed opposite the downstream portion of the base. The projection projects toward the fixing nip in a state in which the heater is installed in the fixing device.

This specification further describes an improved fixing device. In one embodiment, the fixing device includes a fixing rotator that is hollow and endless. The fixing rotator rotates. A pressure rotator presses against the fixing rotator to form a fixing nip between the fixing rotator and the pressure rotator, through which a recording medium bearing an image is conveyed. The heater described above contacts an inner circumferential surface of the fixing rotator.

This specification further describes an improved image forming apparatus. In one embodiment, the image forming apparatus includes an image bearer that bears an image and the fixing device described above that fixes the image on a recording medium.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
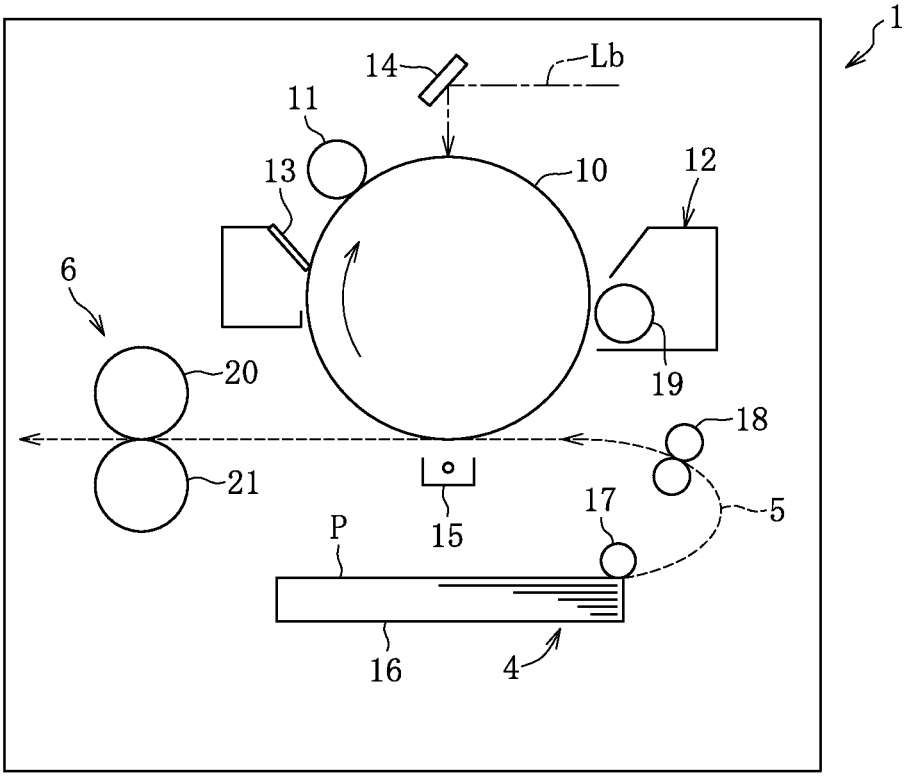
FIG. 1 is a schematic cross-sectional view of an image forming apparatus according to an embodiment of the present disclosure.
Figure 2:
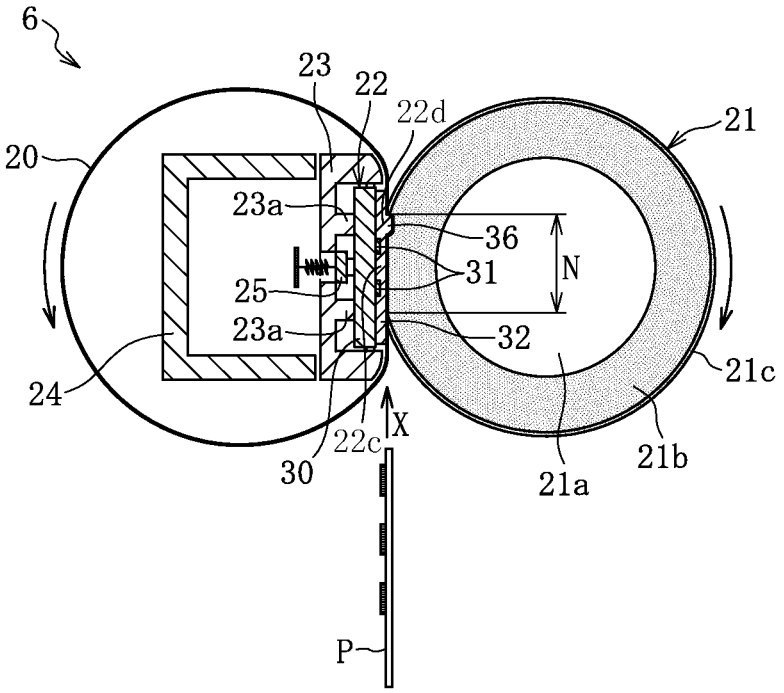
FIG. 2 is a schematic cross-sectional view of a fixing device that is incorporated in the image forming apparatus depicted in FIG. 1 and incorporates a heater according to a first embodiment of the present disclosure.
Figure 3A:
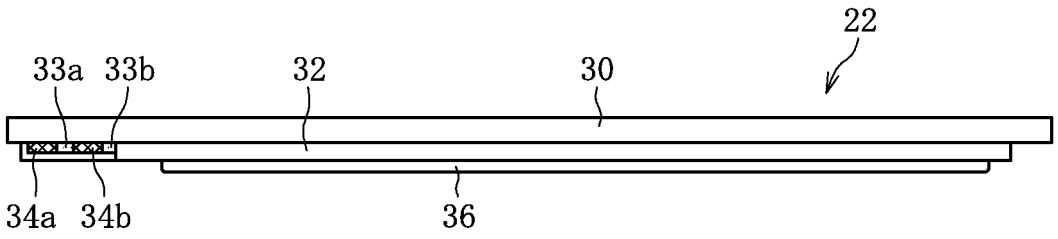
FIG. 3A is a plan view of the heater depicted in FIG. 2, that incorporates resistive heat generators connected in series.
Figure 3B:
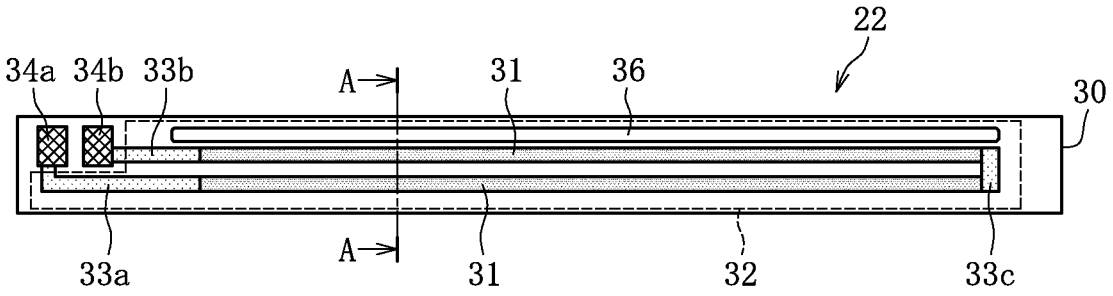
FIG. 3B is a front view of the heater depicted in FIG. 3A.
Figure 10:
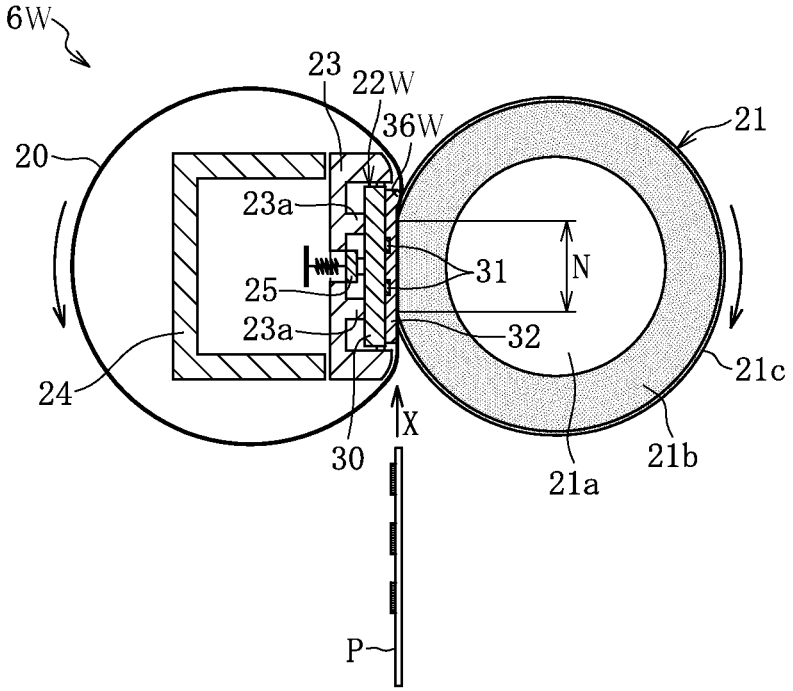
FIG. 10 is a cross-sectional view of a fixing device that is installable in the image forming apparatus depicted in FIG.
Figure 11:
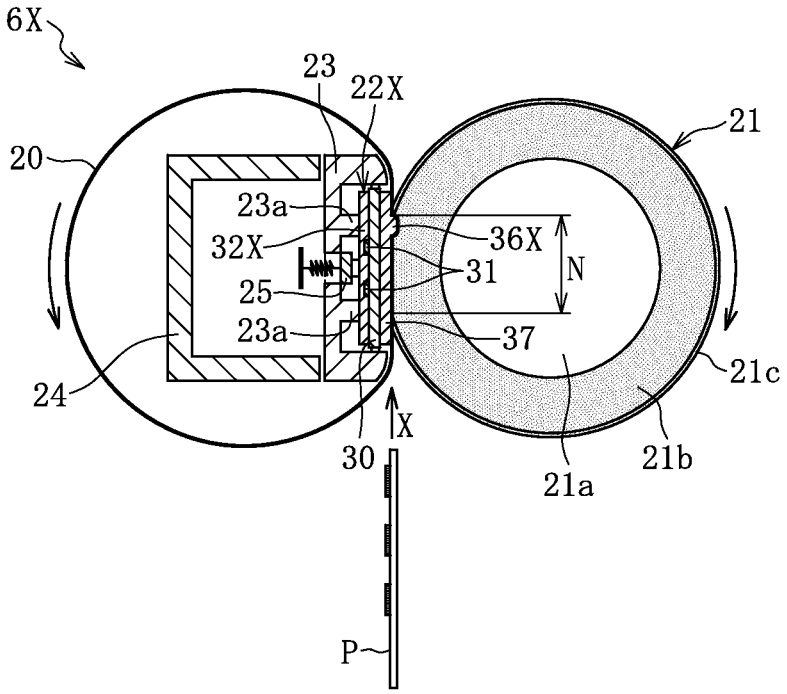
Figure 12A:
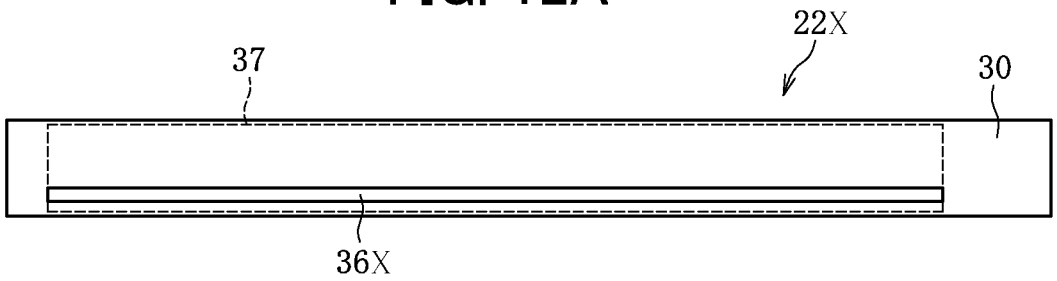
Figure 12B:
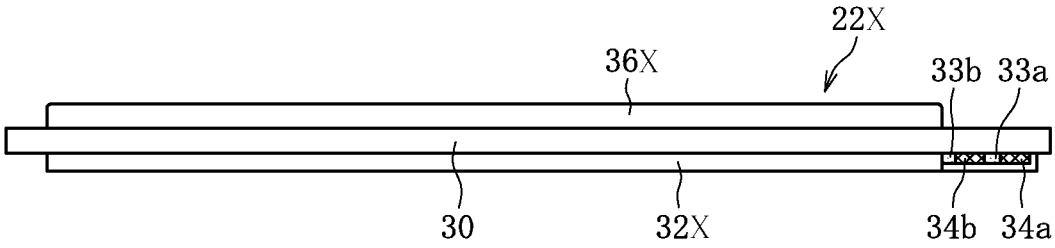
Figure 12C:
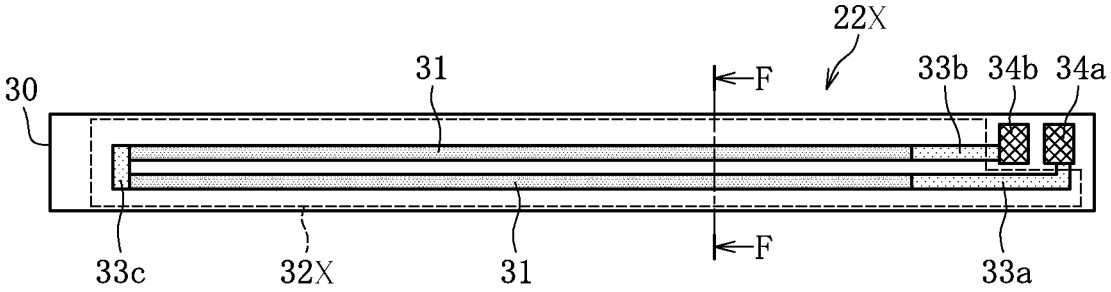
Figure 12D:
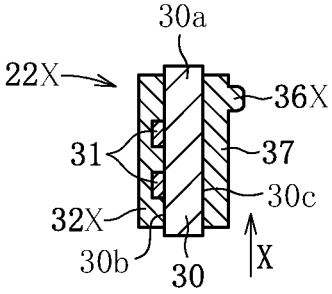
Figure 13:
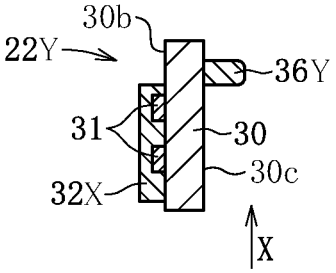
Figure 14:
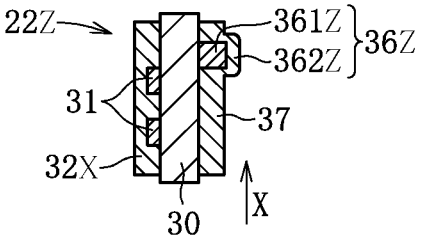
Figure 15:
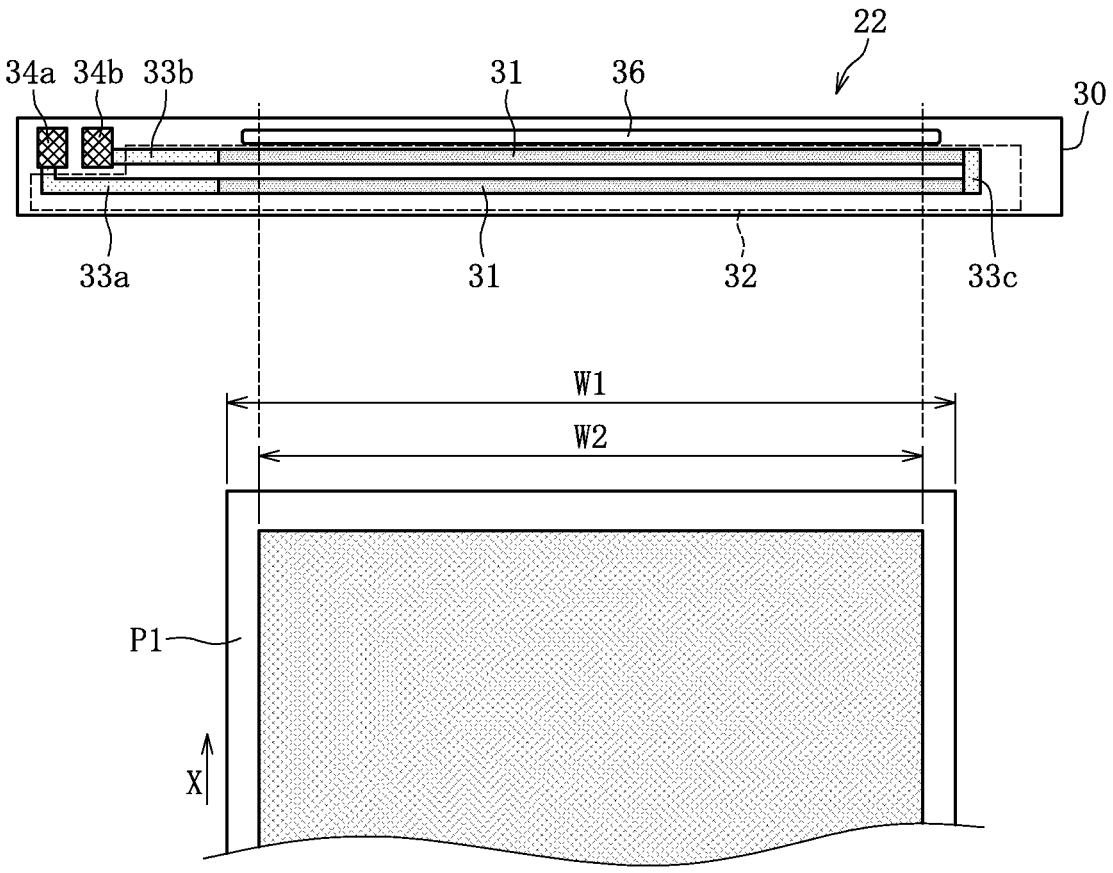
Figure 16:
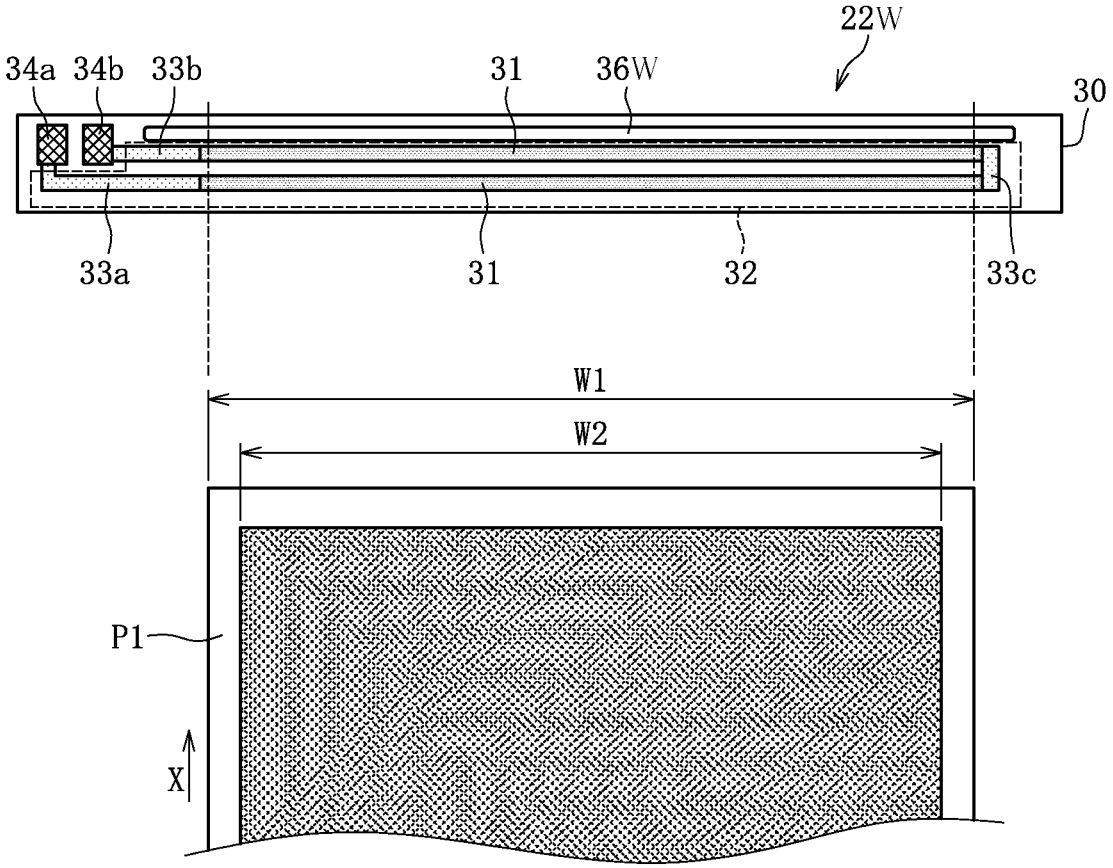

1 and incorporates a heater including a projection disposed downstream from a fixing nip in a sheet conveyance direction;

FIG. 11 is a cross-sectional view of a fixing device that is installable in the image forming apparatus depicted in FIG. 1 and incorporates resistive heat generators mounted on a back face of a base;

FIG. 12A is a back view of a heater according to a sixth embodiment of the present disclosure, that is installable in the fixing device depicted in FIG. 2;

FIG. 12B is a plan view of the heater depicted in FIG. 12A;

FIG. 12C is a front view of the heater depicted in FIG. 12A;

FIG. 12D is a cross-sectional view of the heater depicted in FIG. 12C taken on line F-F in FIG. 12C;

FIG. 13 is a cross-sectional view of a heater according to a seventh embodiment of the present disclosure, that is installable in the fixing device depicted in FIG. 2;

FIG. 14 is a cross-sectional view of a heater according to an eighth embodiment of the present disclosure, that is installable in the fixing device depicted in FIG. 2;

FIG. 15 is a diagram of the heater depicted in FIG. 3B, illustrating a relation in a longitudinal direction thereof between a projection incorporated therein and an image formed on a sheet; and FIG. 16 is a diagram of the heater depicted in FIG. 10, illustrating a relation in a longitudinal direction thereof between a projection incorporated therein and an image formed on a sheet.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to drawings, a description is provided of embodiments of the present disclosure. In the drawings, identical reference numerals are assigned to identical elements and equivalents and redundant descriptions of the identical elements and the equivalents are summarized or omitted properly.

Referring to FIG. 1, a description is provided of a construction of an image forming apparatus 1.

FIG. 1 illustrates the image forming apparatus 1 that is a monochrome image forming apparatus and includes a photoconductive drum 10 serving as an image bearer that bears an image (e.g., a toner image). The photoconductive drum 10 is a drum-shaped rotator that bears toner as a developer on a surface thereof. The photoconductive drum 10 rotates in a rotation direction indicated with an arrow in FIG. 1. The photoconductive drum 10 is surrounded by a charging roller 11, a developing device 12, a cleaning blade 13, and the like. The charging roller 11 uniformly charges the surface of the photoconductive drum 10. The developing device 12 includes a developing roller 19 and the like that supply toner onto the surface of the photoconductive drum 10, forming a toner image thereon. The cleaning blade 13 cleans the surface of the photoconductive drum 10.

An exposure device is disposed above a process unit. The exposure device emits a laser beam Lb according to image data. The laser beam Lb irradiates the surface of the photoconductive drum 10 through a mirror 14.

A transfer device 15 including a transfer charger is disposed opposite the photoconductive drum 10. The transfer device 15 transfers the toner image formed on the surface of the photoconductive drum 10 onto a sheet P.

A sheet feeder 4 is disposed in a lower portion of the image forming apparatus 1. The sheet feeder 4 includes a sheet feeding tray 16 (e.g., a paper tray) and a sheet feeding roller 17. The sheet feeding tray 16 loads a plurality of sheets P serving as recording media. The sheet feeding roller 17 conveys the sheet P from the sheet feeding tray 16 to a conveyance path 5. A registration roller 18 is disposed downstream from the sheet feeding roller 17 in a sheet conveyance direction.

A fixing device 6 includes a fixing belt 20 heated by a heater described below and a pressure roller 21 that presses against the fixing belt 20.

Referring to FIG. 1, a description is provided of a basic image forming operation performed by the image forming apparatus 1 having the construction described above.

As the image forming operation starts, the charging roller 11 charges the surface of the photoconductive drum 10. The exposure device emits a laser beam Lb according to image data, decreasing the electric potential of an irradiated portion on the surface of the photoconductive drum 10, which is irradiated with the laser beam Lb, and forming an electrostatic latent image on the photoconductive drum 10. The developing device 12 supplies toner to the electrostatic latent image formed on the surface of the photoconductive drum 10, visualizing the electrostatic latent image as a visible toner image (e.g., a developed image). The cleaning blade 13 removes toner and the like failed to be transferred onto the sheet P and therefore remained on the photoconductive drum 10 therefrom.

On the other hand, as the image forming operation starts, in the lower portion of the image forming apparatus 1, the sheet feeding roller 17 of the sheet feeder 4 starts being driven and rotated, feeding a sheet P of the plurality of sheets P loaded in the sheet feeding tray 16 to the conveyance path 5.

The registration roller 18 conveys the sheet P sent to the conveyance path 5 to a transfer portion where the transfer device 15 is disposed opposite the photoconductive drum 10 at a time when the toner image formed on the surface of the photoconductive drum 10 is disposed opposite the sheet P at the transfer portion. The transfer device 15 applies a transfer bias that transfers the toner image from the photoconductive drum 10 onto the sheet P.

The sheet P transferred with the toner image is conveyed to the fixing device 6 where the fixing belt 20 that is heated and the pressure roller 21 fix the toner image on the sheet P under heat and pressure. The sheet P fixed with the toner image is separated from the fixing belt 20 and conveyed by a conveying roller pair disposed downstream from the fixing device 6 in the sheet conveyance direction. The sheet P bearing the fixed toner image is ejected onto a sheet ejection tray disposed on an exterior of the image forming apparatus 1.

A description is provided of a construction of the fixing device 6 according to a first embodiment of the present disclosure.

As illustrated in FIG. 2, the fixing device 6 according to this embodiment includes the fixing belt 20, the pressure roller 21, a heater 22, a heater holder 23, a stay 24, and thermistors 25. The fixing belt 20 is an endless belt serving as a fixing rotator or a fixing member. The pressure roller 21 serves as a pressure rotator or a pressure member that contacts an outer circumferential surface of the fixing belt 20 to form a nip, that is, a fixing nip N, between the fixing belt 20 and the pressure roller 21. The heater 22 serves as a heater or a heating member that heats the fixing belt 20. The heater holder 23 serves as a holder that holds or supports the heater 22. The stay 24 serves as a support that supports the heater holder 23. The thermistors 25 serve as temperature detectors that detect the temperature of the heater 22. A heating controller controls power supplied to the heater 22 based on the temperature of the heater 22, that is detected by the thermistors 25, thus adjusting the temperature of the fixing belt 20 to a desired temperature.

A detailed description is now given of a construction of the fixing belt 20.

The fixing belt 20 includes a tubular base that is made of polyimide (PI) and has an outer diameter of 25 mm and a thickness in a range of from 40 micrometers to 120 micrometers, for example. The fixing belt 20 further includes a release layer serving as an outermost surface layer. The release layer is made of fluororesin, such as tetrafluoroethylene-perfluoroalkylvinylether copolymer (PFA) and polytetrafluoroethylene (PTFE), and has a thickness in a range of from 5 micrometers to 50 micrometers to enhance durability of the fixing belt 20 and facilitate separation of the sheet P and a foreign substance from the fixing belt 20. Optionally, an elastic layer that is made of rubber or the like and has a thickness in a range of from 50 micrometers to 500 micrometers may be interposed between the base and the release layer. The base of the fixing belt 20 may be made of heat resistant resin such as polyetheretherketone (PEEK) or metal such as nickel (Ni) and SUS stainless steel, instead of polyimide. An inner circumferential surface of the fixing belt 20 may be coated with polyimide, PTFE, or the like to produce a slide layer.

A detailed description is now given of a construction of the pressure roller 21.

The pressure roller 21 has an outer diameter of 25 mm, for example. The pressure roller 21 includes a cored bar 21*a*, an elastic layer 21*b*, and a release layer 21*c*. The cored bar 21*a* is solid and made of metal such as iron. The elastic layer 21*b* is disposed on a surface of the cored bar 21*a*. The release layer 21*c* coats an outer surface of the elastic layer 21*b*. The elastic layer 21*b* is made of silicone rubber and has a thickness of 3.5 mm, for example. In order to facilitate separation of the sheet P and the foreign substance from the pressure roller 21, the release layer 21*c* that is made of fluororesin and has a thickness of about 40 micrometers, for example, is preferably disposed on the outer surface of the elastic layer 21*b*.

A biasing member biases the pressure roller 21 toward the fixing belt 20, pressing the pressure roller 21 against the heater 22 via the fixing belt 20. Thus, the fixing nip N is formed between the fixing belt 20 and the pressure roller 21. A driver drives and rotates the pressure roller 21. As the pressure roller 21 rotates in a rotation direction indicated with an arrow in FIG. 2, the fixing belt 20 is driven and rotated by the pressure roller 21.

A detailed description is now given of a construction of the heater 22.

The heater 22 is a laminated heater that is elongated in a longitudinal direction thereof throughout an entire length of the fixing belt 20 in a longitudinal direction, that is, an axial direction, of the fixing belt 20. The longitudinal direction of the fixing belt 20 is perpendicular to a plane of paper in FIG. 2 and parallel to the longitudinal direction of the heater 22 and a longitudinal direction of the heater holder 23. The heater 22 includes a base 30 that is platy, resistive heat generators 31 serving as heat generators that are disposed on the base 30, and a protective layer 32 that coats the resistive heat generators 31. The protective layer 32 of the heater 22 contacts the inner circumferential surface of the fixing belt 20. Heat generated by the resistive heat generators 31 is conducted to the fixing belt 20 through the protective layer 32.

A detailed description is now given of a construction of the heater holder 23 and the stay 24.

The heater holder 23 and the stay 24 are disposed inside a loop formed by the fixing belt 20. The stay 24 includes a channel made of metal. Both lateral ends of the stay 24 in a longitudinal direction thereof are supported by side plates of the fixing device 6, respectively. Since the stay 24 supports the heater holder 23 and the heater 22 supported by the heater holder 23, in a state in which the pressure roller 21 is pressed against the fixing belt 20, the heater 22 receives pressure from the pressure roller 21 precisely to form the fixing nip N stably.

Since the heater holder 23 is subject to high temperatures by heat from the heater 22, the heater holder 23 is preferably made of a heat resistant material. For example, if the heater holder 23 is made of heat resistant resin having a decreased thermal conductivity, such as liquid crystal polymer (LCP), the heater holder 23 suppresses conduction of heat thereto from the heater 22, facilitating heating of the fixing belt 20. In order to decrease a contact area where the heater holder 23 contacts the heater 22 and thereby reduce an amount of heat conducted from the heater 22 to the heater holder 23, the heater holder 23 includes projections 23*a* that contact the base 30 of the heater 22. According to this embodiment, the projections 23*a* of the heater holder 23 do not contact a part of a back face of the base 30, which is opposite the resistive heat generators 31 mounted on a front face of the base 30, that is, a part of the base 30, which is susceptible to temperature increase, thus decreasing the amount of heat conducted to the heater holder 23 further and heating the fixing belt 20 effectively.

In the fixing device 6 according to this embodiment, when printing starts, the driver drives and rotates the pressure roller 21 and the fixing belt 20 starts rotation in accordance with rotation of the pressure roller 21. Additionally, as power is supplied to the resistive heat generators 31 of the heater 22, the heater 22 heats the fixing belt 20. In a state in which the temperature of the fixing belt 20 reaches a predetermined target temperature (e.g., a fixing temperature), as a sheet P bearing an unfixed toner image is conveyed in a sheet conveyance direction X through the fixing nip N formed between the fixing belt 20 and the pressure roller 21, the fixing belt 20 and the pressure roller 21 fix the unfixed toner image on the sheet P under heat and pressure.

A description is provided of the construction of the heater 22 in more detail.

Figure 3C:
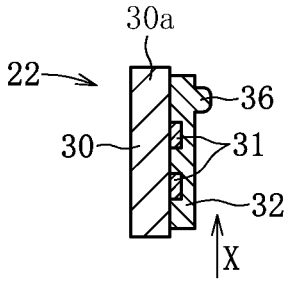
FIG. 3C is a cross-sectional view of the heater depicted in FIG. 3B taken on line A-A in FIG. 3B.
Figure 4A:
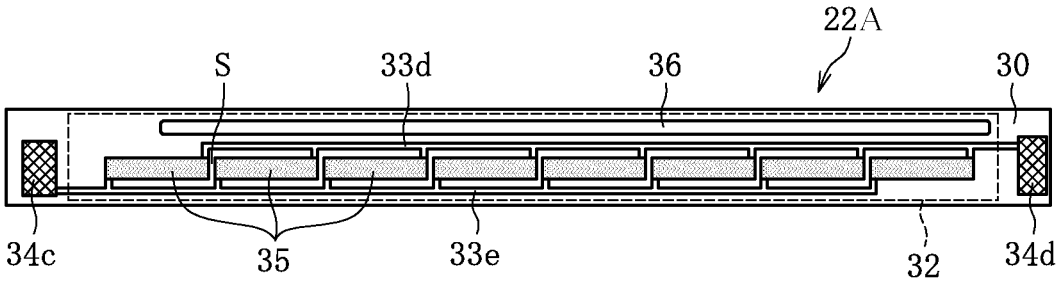
FIG. 4A is a front view of a heater installable in the fixing device depicted in FIG. 2, that incorporates resistive heat generators connected in parallel as a first example.
Figure 4B:
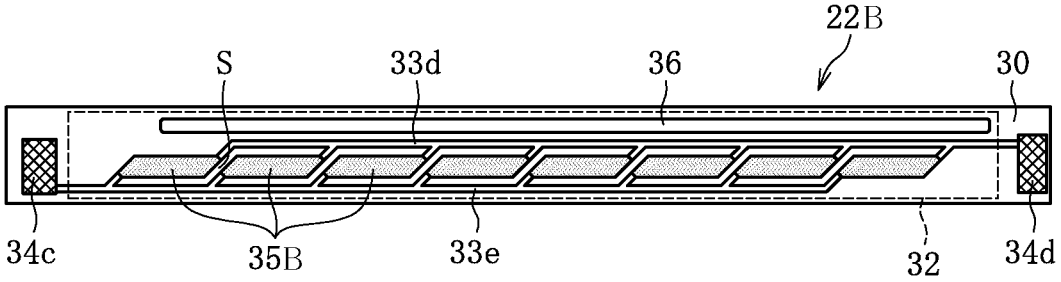
FIG. 4B is a front view of a heater installable in the fixing device depicted in FIG. 2, that incorporates resistive heat generators connected in parallel as a second example.
Figure 4C:
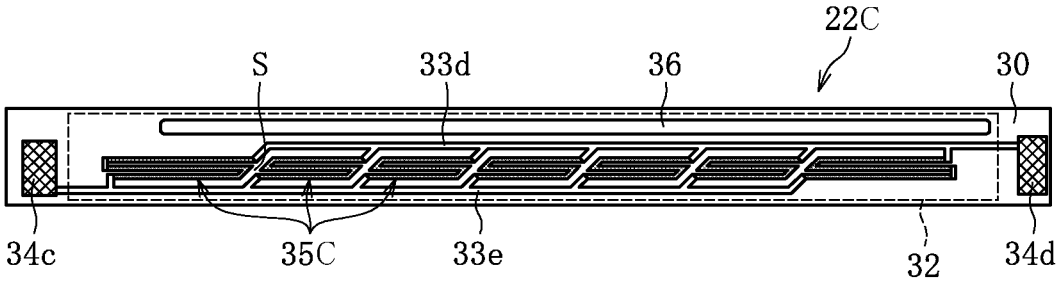
FIG. 4C is a front view of a heater installable in the fixing device depicted in FIG. 2, that incorporates resistive heat generators connected in parallel as a third example.

As constructions of heaters according to the embodiments of the present disclosure, the following describes a construction of the heater 22 including the resistive heat generators 31 connected in series as illustrated in FIGS. 3A, 3B, and 3C and a construction of each of a heater 22A incorporating resistive heat generators 35 connected in parallel, a heater 22B incorporating resistive heat generators 35B connected in parallel, and a heater 22C incorporating resistive heat generators 35C connected in parallel as illustrated in FIGS. 4A, 4B, and 4C, respectively. The positions and the number of the resistive heat generators 31, 35, 35B, and 35C described below are examples and modified properly according to the type and the like of sheets P conveyed through the fixing device 6.

As illustrated in FIGS. 3A, 3B, and 3C, a surface of the base 30, that is, an elongate plate, mounts the resistive heat generators 31, feeders 33*a*, 33*b*, and 33*c*, electrodes 34*a* and 34*b*, and the like. The resistive heat generators 31 are arranged in two lines and extended in the longitudinal direction of the heater 22. The feeders 33*a*, 33*b*, and 33*c* serve as conductors. The protective layer 32 covers the surface of the base 30, the resistive heat generators 31, and the feeders 33*a*, 33*b*, and 33*c*.

The base 30 is preferably made of ceramic (e.g., alumina and aluminum nitride), glass, mica, or heat resistant resin (e.g., polyimide), which has an increased heat resistance and an increased insulation. According to the embodiments, the base 30 is made of an insulating material.

The resistive heat generators 31 and the feeders 33*a*, 33*b*, and 33*c* are made of a conductive material produced by mixing silver (Ag), palladium (Pd), platinum (Pt), ruthenium oxide ($RuO_2$), and the like.

The protective layer 32 is preferably made of ceramic (e.g., alumina and aluminum nitride), glass, mica, or heat resistant resin (e.g., polyimide), which improves heat resistance and insulation of the protective layer 32.

The resistive heat generators 31 are connected to the electrodes 34*a* and 34*b* through the feeders 33*a* and 33*b*, respectively, at one lateral end of each of the resistive heat generators 31 in a longitudinal direction thereof. A connector and the like contact the electrodes 34*a* and 34*b*, electrically connecting the heater 22 to an external device. The resistive heat generators 31 are connected to each other through the feeder 33*c* extending in a short direction of the heater 22 at another lateral end of each of the resistive heat generators 31 in the longitudinal direction thereof. The protective layer 32 covers the base 30, the resistive heat generators 31, and the feeders 33*a*, 33*b*, and 33*c*. The protective layer 32 protects the base 30, the resistive heat generators 31, and the feeders 33*a*, 33*b*, and 33*c* and insulates the heater 22 from the fixing belt 20.

FIG. 3C is a cross-sectional view of the heater 22 taken on line A-A in FIG. 3B. As illustrated in FIG. 3C, a projection 36 is mounted on a surface of a downstream portion 30*a* of the base 30 in the sheet conveyance direction X, as described below in detail.

Referring to FIGS. 4A, 4B, and 4C, a description is provided of the construction of each of the heaters 22A, 22B, and 22C incorporating the resistive heat generators 35, 35B, and 35C connected in parallel, respectively.

As illustrated in FIG. 4A, the base 30 mounts the plurality of resistive heat generators 35, that is, eight resistive heat generators 35 according to this embodiment. The resistive heat generators 35 serving as heat generators are arranged in a longitudinal direction of the heater 22A. Feeders 33*d* and 33*e* are disposed at both ends of the base 30, respectively, in a short direction thereof. Both lateral ends of each of the resistive heat generators 35 in a longitudinal direction of the base 30 are coupled to the feeders 33*d* and 33*e*, respectively. The resistive heat generators 35 are connected in parallel. The feeders 33*d* and 33*e* are coupled to electrodes 34*d* and 34*c*, respectively, at one lateral end of each of the feeders 33*d* and 33*e* in the longitudinal direction of the heater 22A.

According to this embodiment, each of the resistive heat generators 35 is made of a material having a positive temperature coefficient of resistance (TCR) that is characterized in that, as the temperature of the resistive heat generators 35 increases, the electric resistance value thereof increases, decreasing the output of the heater 22A in portions thereof where the resistive heat generators 35 are disposed.

Like the resistive heat generators 31 described above, the resistive heat generators 35 are made of a conductive material produced by mixing silver (Ag), palladium (Pd), platinum (Pt), ruthenium oxide ($RuO_2$), and the like.

According to the embodiments of the present disclosure, when a small sheet P having a small width in the longitudinal direction of the fixing belt 20 is conveyed through the fixing device 6, the small sheet P does not draw heat from both lateral ends of the fixing belt 20 in the longitudinal direction thereof and the resistive heat generators 35 disposed opposite both lateral ends of the fixing belt 20, that is, both lateral ends of the heater 22A in the longitudinal direction thereof. Accordingly, both lateral ends of the fixing belt 20 in the longitudinal direction thereof and the resistive heat generators 35 disposed opposite both lateral ends of the fixing belt 20 suffer from relatively high temperatures and relatively high resistance values. Since a constant voltage is applied to the resistive heat generators 35, an output from the resistive heat generators 35 disposed opposite both lateral ends of the fixing belt 20 in the longitudinal direction thereof decreases relatively, decreasing an amount of heat generated by the resistive heat generators 35. Thus, the resistive heat generators 35 suppress an amount of heat generated by the heater 22A in a non-conveyance span where the small sheet P is not conveyed, preventing overheating of the fixing belt 20 in the non-conveyance span.

Conversely, for example, the heater 22 incorporating the resistive heat generators 31 connected in series as illustrated in FIGS. 3A, 3B, and 3C may prevent overheating of both lateral ends of the fixing belt 20 in the longitudinal direction thereof by decreasing print speed. However, the heater 22A incorporating the resistive heat generators 35 connected in parallel prevents overheating of the fixing belt 20 while suppressing decrease in print speed.

As illustrated in FIG. 4B, each of the resistive heat generators 35B is inclined into substantially a parallelogram. With the resistive heat generators 35 that are substantially rectangular as illustrated in FIG. 4A, a heat generation amount of the heater 22A at a gap S between adjacent ones of the resistive heat generators 35 decreases substantially compared to a portion of the heater 22A other than the gap S in the longitudinal direction of the heater 22A, causing uneven temperature of the fixing belt 20. Conversely, according to the embodiment illustrated in FIG. 4B, the adjacent ones of the resistive heat generators 35B, each of which is substantially the parallelogram, overlap in a longitudinal direction of the heater 22B, suppressing uneven temperature of the fixing belt 20.

As illustrated in FIG. 4C, each of the resistive heat generators 35C is an elongate linear portion that is bent and turned into a serpentine shape. Since the resistive heat generators 35C are elongated, even if the resistive heat generators 35C are made of a material that has a low resistance value and is available at reduced costs, the resistive heat generators 35C achieve a desired heat generation amount, reducing manufacturing costs of the heater 22C.

As illustrated in FIGS. 4A, 4B, and 4C, the projection 36 is mounted on the surface of the base 30 of each of the heaters 22A, 22B, and 22C, as described below in detail.

As described above, a heater (e.g., the heater 22) incorporating resistive heat generators (e.g., the resistive heat generators 31) connected in series or a heater (e.g., the heaters 22A, 22B, and 22C) incorporating resistive heat generators (e.g., the resistive heat generators 35, 35B, and 35C) connected in parallel is employed as a heater according to the embodiments of the present disclosure. The following describes the construction of the heater 22 depicted in FIGS. 3A, 3B, and 3C, that incorporates the resistive heat generators 31 connected in series as one example.

Figure 5:
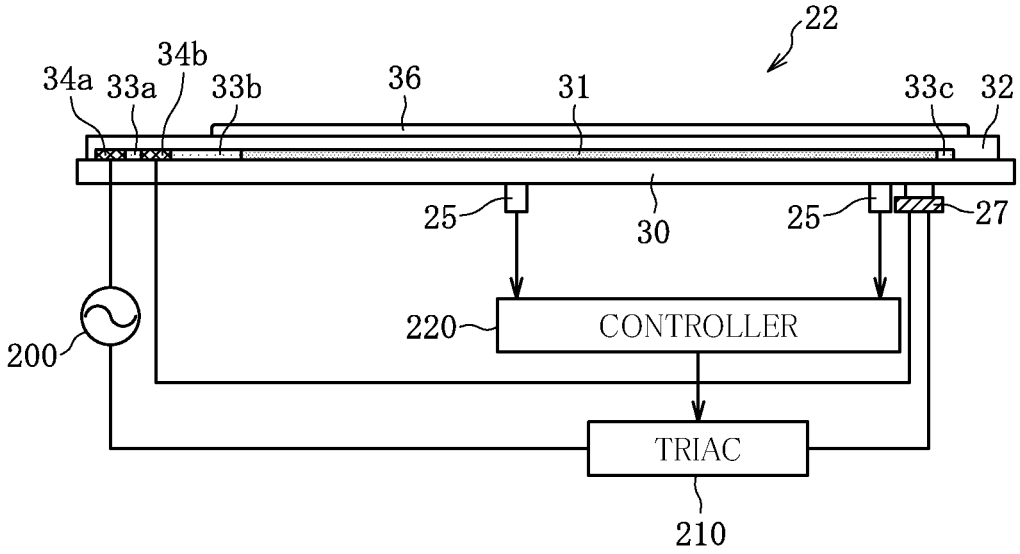
FIG. 5 is a diagram of a power supply circuit that supplies power to the heater depicted in FIG. 2.

As illustrated in FIG. 5, according to the embodiments, a power supply circuit for supplying power to each of the resistive heat generators 31 is constructed by electrically connecting an alternating current power supply 200 serving as an external device of the heater 22 to the electrodes 34*a* and 34*b* of the heater 22. The power supply circuit includes a triac 210 that controls an amount of power supplied to each of the resistive heat generators 31. A controller 220 includes a microcomputer that includes a central processing unit (CPU), a read-only memory (ROM), a random access memory (RAM), and an input-output (I/O) interface.

According to the embodiments, the thermistors 25 serving as temperature detectors are disposed opposite a center span of the heater 22 in the longitudinal direction thereof, that is, a minimum sheet conveyance span where a minimum size sheet P is conveyed, and one lateral end span of the heater 22 in the longitudinal direction thereof, respectively. Further, a thermostat 27 serving as a power interrupter is disposed at one lateral end of the heater 22 in the longitudinal direction thereof. The thermostat 27 interrupts supplying power to the resistive heat generators 31 when a temperature of the resistive heat generators 31 is a predetermined temperature or higher. The thermistors 25 and the thermostat 27 contact the back face of the base 30, that is opposite the front face of the base 30, that mounts the resistive heat generators 31. The thermistors 25 and the thermostat 27 detect the temperature of the resistive heat generators 31.

The controller 220 controls the amount of power supplied to each of the resistive heat generators 31 through the triac 210 based on temperatures of the resistive heat generators 31, that are detected by the thermistors 25, respectively. When a sheet P is conveyed to the fixing device 6, the controller 220 determines the amount of power supplied to each of the resistive heat generators 31 by considering an amount of heat drawn by the sheet P.

A description is provided of a construction of a comparative heater.

The comparative heater includes a base made of a metal plate. The base is bent by hemming to produce a projection disposed at a position on the base, that defines an exit of a fixing nip. Accordingly, the projection is disposed opposite a downstream portion of the fixing nip in a recording medium conveyance direction, improving fixing of a toner image on a recording medium.

Since the projection is produced by processing the base, the projection has a predetermined height or higher due to restriction in processing. Hence, the projection may have a height that is excessively high, increasing a frictional resistance between the base and a fixing rotator (e.g., a fixing belt) that slides over the base and causing the fixing rotator and the like to be damaged easily.

A detailed description is provided of a configuration of the projection 36 mounted on the surface of the base 30 of the heater 22 according to a first embodiment of the present disclosure.

As illustrated in FIGS. 3A, 3B, and 3C, the projection 36 is mounted on the surface of the base 30 and is extended in the longitudinal direction of the base 30. The projection 36 is mounted on a portion on the surface of the base 30 where the resistive heat generators 31 are not disposed. For example, the projection 36 is shifted from the resistive heat generators 31. Specifically, the projection 36 is disposed above the resistive heat generators 31 in FIG. 3B and disposed downstream from the resistive heat generators 31 in the sheet conveyance direction X. As illustrated in FIG. 3C, the projection 36 is mounted on the downstream portion 30*a* of the base 30. The projection 36 is disposed separately from the base 30. According to this embodiment, the projection 36 is a part of the protective layer 32.

As illustrated in FIG. 2, the projection 36 projects toward the fixing nip N and the pressure roller 21. According to this embodiment, the projection 36 is disposed opposite a downstream portion of the fixing nip N in the sheet conveyance direction X. As illustrated in FIG. 2, since the projection 36 is mounted on the surface of the base 30, a downstream portion 22*d* of the heater 22 in the sheet conveyance direction X protrudes beyond a center portion 22*c* of the heater 22 in the sheet conveyance direction X toward the fixing nip N. The downstream portion 22*d* is disposed downstream from the center portion 22*c* in the sheet conveyance direction X. The center portion 22*c* of the heater 22 in the sheet conveyance direction X defines a middle region of the heater 22 when the heater 22 is divided into three regions in the sheet conveyance direction X. The downstream portion 22*d* of the heater 22 in the sheet conveyance direction X defines a downstream region of the heater 22, that is disposed downstream from the middle region in the sheet conveyance direction X.

The projection 36 defines a projecting shape that projects toward the pressure roller 21 and is disposed opposite the downstream portion of the fixing nip N at a part of the heater 22. Accordingly, the projection 36 increases pressure applied to the sheet P at the downstream portion of the fixing nip N during a latter half of fixing, improving fixing performance of fixing the toner image on a surface of the sheet P.

As illustrated in FIG. 2, the protective layer 32 has a nip forming face that faces the fixing belt 20 and forms the fixing nip N. The projection 36 defines a first part of the nip forming face. The projection 36 preferably protrudes beyond a second part of the nip forming face, that is other than the first part, by a range of from 40 micrometers to 400 micrometers. Since the projection 36 has a height in the range of from 40 micrometers to 400 micrometers, the projection 36 sufficiently increases pressure applied to the sheet P at the downstream portion of the fixing nip N during the latter half of fixing, achieving fixing performance of fixing the toner image on the sheet P. If the height of the projection 36 is excessively high, the fixing belt 20 may slide over the heater 22 with an increased frictional resistance. Accordingly, the fixing belt 20 may suffer from early breakage. Further, the fixing belt 20 may engage the pressure roller 21 with a substantial amount, causing early breakage of the pressure roller 21. To address this circumstance, the projection 36 having the height in the range of from 40 micrometers to 400 micrometers prevents early breakage of the fixing belt 20 and the pressure roller 21. In order to prevent early breakage of the fixing belt 20 and the pressure roller 21, the projection 36 preferably has a height of 300 micrometers or smaller.

Next, a description is provided of a method for manufacturing the heater 22.

Paste made of the conductive material described above, of which the resistive heat generators 31, the feeders 33*a*, 33*b*, and 33*c*, and the like are made, coats the surface of the base 30, that is, a plate, by screen printing. Thereafter, the base 30 is subject to firing. The processes described above are repeated to produce a multilayer that has a desired thickness. The protective layer 32 coats the multilayer, producing the heater 22. The number of layers of the multilayer increases in a downstream portion of the protective layer 32 in the sheet conveyance direction X where the projection 36 is disposed. Thus, the downstream portion of the protective layer 32 protrudes beyond a portion of the protective layer 32, other than the downstream portion, producing the projection 36.

For example, as a construction different from the construction of the heater 22 according to this embodiment, a base made of a metal plate is bent by hemming to produce a projection that is combined or molded with the base. The projection that is molded by bending has a minimum height that is determined based on a plate thickness of the base. Accordingly, it may be difficult to set the height of the projection within the above-described range depending on the plate thickness of the base, causing early breakage of the fixing belt 20 and the pressure roller 21. Conversely, according to this embodiment, the projection 36 is disposed separately from the base 30. For example, the projection 36 is not molded with the base 30. Accordingly, the projection 36 attains a desired height, preventing early breakage of the fixing belt 20 and the pressure roller 21 as described above.

If a part of the base is bent by hemming as described above to produce the projection molded with the base and the resistive heat generators 31 and the like are produced by screen printing as described above, the thickness and the width of each of the resistive heat generators 31 may vary depending on lifting of a plate and uneven contact of a spueegee. Accordingly, each of the resistive heat generators 31 may suffer from variation in the resistance locally and variation in the heat generation amount. Further, each of the resistive heat generators 31 is subject to disconnection locally at a portion of the resistive heat generator 31 where the thickness and the width of the resistive heat generator 31 decrease. Conversely, according to this embodiment, the projection 36 is disposed separately from the base 30. Hence, the projection 36 is not produced during screen printing, not hindering screen printing. Consequently, the projection 36 prevents variation in the thickness and the width of each of the resistive heat generators 31 due to lifting of the plate and uneven contact of the spueegee described above.

A description is provided of constructions of heaters 22S, 22T, 22U, 22V, 22W, 22X, 22Y, and 22Z according to second to eighth embodiments sequentially, which incorporate projections, respectively, that are different from the projection 36 of the heater 22 according to the first embodiment described above.

Hereinafter, the embodiments are described mainly of configurations that are different from those of the first embodiment described above. A description of other configurations that are common to the first embodiment described above is omitted properly.

Figure 6A:
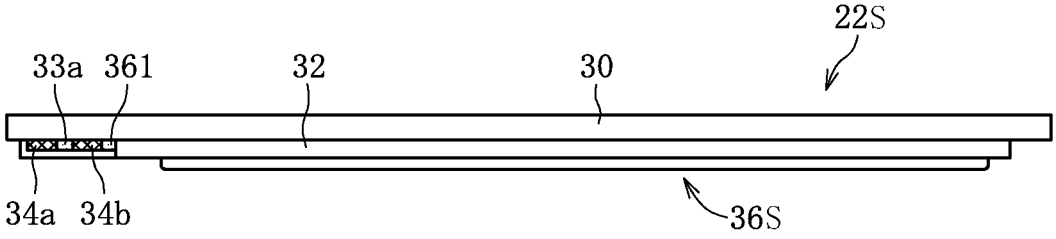
FIG. 6A is a plan view of a heater according to a second embodiment of the present disclosure, that is installable in the fixing device depicted in FIG. 2.
Figure 6B:
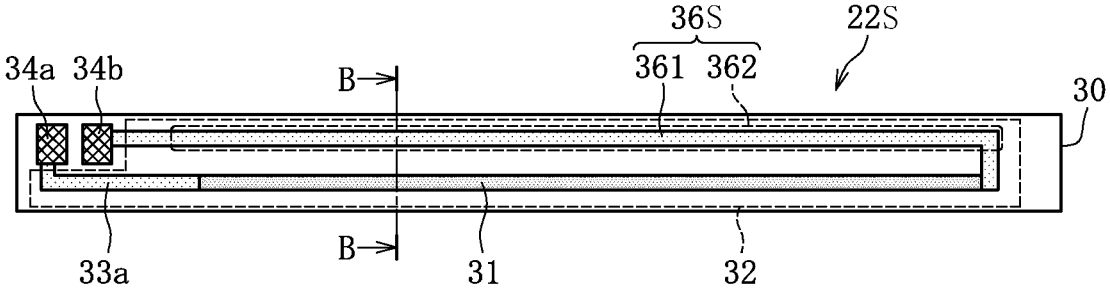
FIG. 6B is a front view of the heater depicted in FIG. 6A.
Figure 6C:
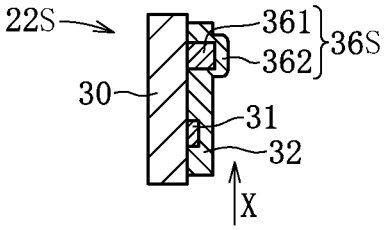
FIG. 6C is a cross-sectional view of the heater depicted in FIG. 6B taken on line B-B in FIG. 6B.

Referring to FIGS. 6A, 6B, and 6C, a description is provided of the construction of the heater 22S according to the second embodiment of the present disclosure.

FIG. 6C is a cross-sectional view of the heater 22S taken on line B-B in FIG. 6B. As illustrated in FIGS. 6A, 6B, and 6C, the heater 22S according to the second embodiment includes a projection 36S constructed of a feeder 361 serving as a conductor and a cover portion 362 incorporated in the protective layer 32. The cover portion 362 covers a surface of the feeder 361 mounted on the base 30. As illustrated in FIG. 6B, according to this embodiment, a single resistive heat generator, that is, the resistive heat generator 31, is mounted on the surface of the base 30. The feeder 361 couples the resistive heat generator 31 to the electrode 34*b*. Thus, a part of the feeder 361 electrically connected to the electrode 34*b* constructs a part of the projection 36S. A height of the feeder 361 is greater than a height of the feeder 33*a* such that the projection 36S has a desired height.

As described above, the projection 36 disposed opposite or mounted on the base 30 is a part of the protective layer 32. The projection 36S disposed opposite or mounted on the base 30 is a part of the feeder 361. Thus, a projection (e.g., the projections 36 and 36S) is a part of an element of a heater (e.g., the heaters 22 and 22S) and a part of the element mounted on the base 30. Alternatively, a projection may be disposed separately from the element of the heater.

Figure 7A:
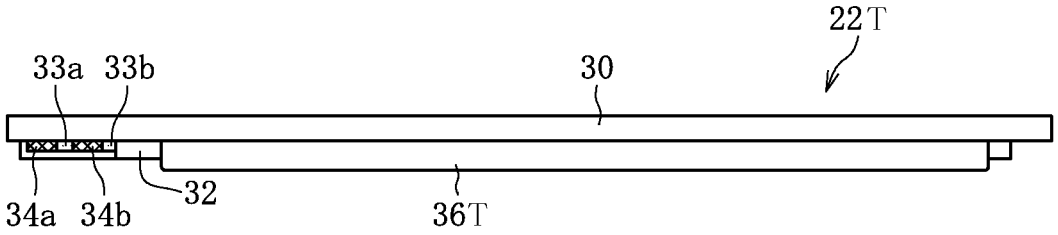
FIG. 7A is a plan view of a heater according to a third embodiment of the present disclosure, that is installable in the fixing device depicted in FIG. 2.
Figure 7B:
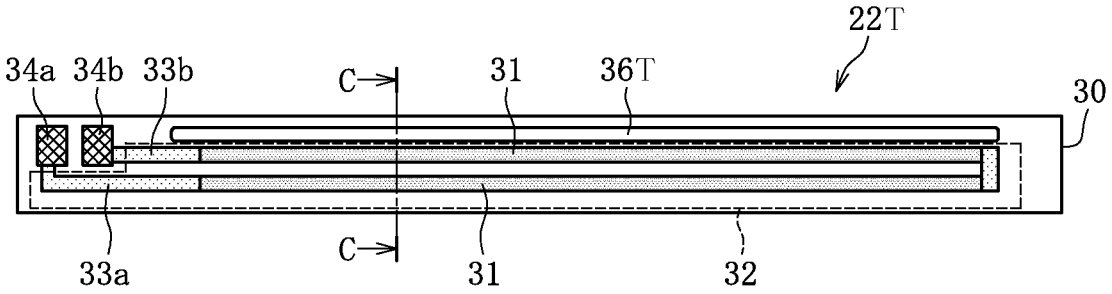
FIG. 7B is a front view of the heater depicted in FIG. 7A.
Figure 7C:
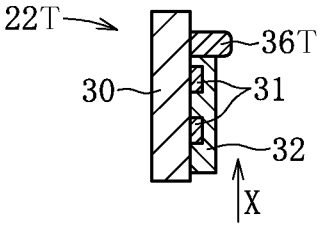
FIG. 7C is a cross-sectional view of the heater depicted in FIG. 7B taken on line C-C in FIG. 7B.

Referring to FIGS. 7A, 7B, and 7C, a description is provided of the construction of the heater 22T according to the third embodiment of the present disclosure.

FIG. 7C is a cross-sectional view of the heater 22T taken on line C-C in FIG. 7B. As illustrated in FIGS. 7A, 7B, and 7C, the heater 22T according to the third embodiment includes a projection 36T disposed separately from the protective layer 32. The projection 36T is not electrically connected to the electrodes 34*a* and 34*b*.

The projection 36T is made of a material that is equivalent to a material of the resistive heat generators 31 or a material of the feeders 33*a*, 33*b*, and 33*c*, for example. In order to produce the projection 36T, the projection 36T is made of a pattern material that is equivalent to a pattern material of the resistive heat generators 31 and the feeders 33*a*, 33*b*, and 33*c* of the heater 22T. Thus, the projection 36T is produced without preparing a different material. Alternatively, the projection 36T may be made of a material different from the material used to produce the heater 22T.

If the projection 36T is made of the pattern material described above, the paste made of the conductive material repeatedly coats the base 30 by screen printing as described above into a multilayer. The number of coatings on a mounting portion of the base 30, that mounts the projection 36T, is greater than the number of coatings on a non-mounting portion of the base 30 other than the mounting portion. Accordingly, a height of the paste on the mounting portion of the base 30 is greater than a height of the paste on the non-mounting portion of the base 30, producing the projection 36T having a desired height.

Since the projection 36T according to this embodiment is not electrically connected to the electrodes 34*a* and 34*b*, the fixing belt 20 is not insulated from the projection 36T. Hence, according to this embodiment, as illustrated in FIG. 7C, the protective layer 32 is not disposed as a surface of the projection 36T.

In other words, according to this embodiment, the protective layer 32 does not construct a part of the projection 36T.

Alternatively, the protective layer 32 may cover the projection 36T or the protective layer 32 may construct a part of the projection 36T.

Figure 8A:
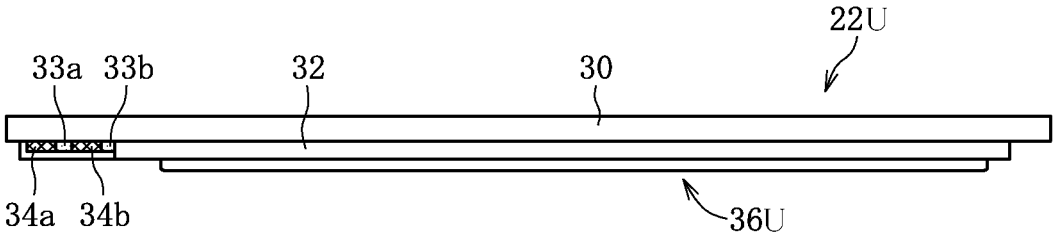
FIG. 8A is a plan view of a heater according to a fourth embodiment of the present disclosure, that is installable in the fixing device depicted in FIG. 2.
Figure 8B:
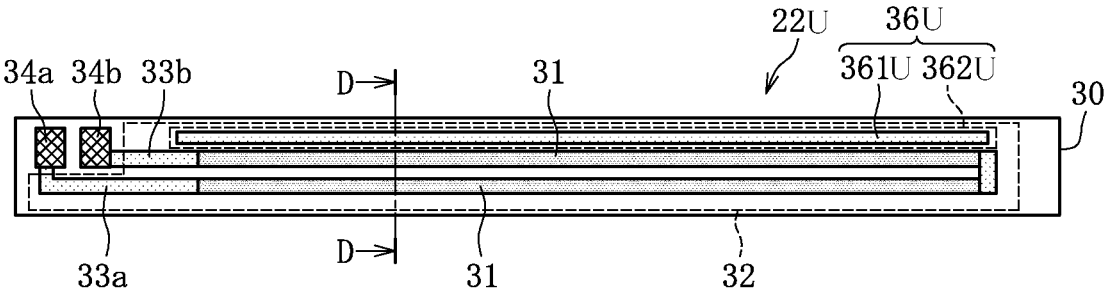
FIG. 8B is a front view of the heater depicted in FIG. 8A.
Figure 8C:
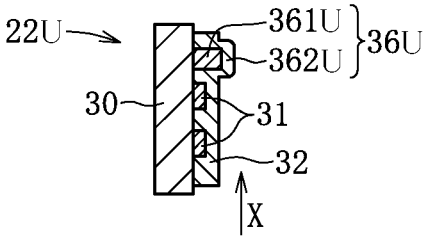
FIG. 8C is a cross-sectional view of the heater depicted in FIG. 8B taken on line D-D in FIG. 8B.

Referring to FIGS. 8A, 8B, and 8C, a description is provided of the construction of the heater 22U according to the fourth embodiment of the present disclosure.

FIG. 8C is a cross-sectional view of the heater 22U taken on line D-D in FIG. 8B. As illustrated in FIGS. 8A, 8B, and 8C, the heater 22U according to the fourth embodiment includes a projection 36U constructed of a protrusion 361U and a cover portion 362U. The protrusion 361U is mounted on the base 30 and is not connected to the electrodes 34*a* and 34*b*. The cover portion 362U is incorporated in the protective layer 32 and covers a surface of the protrusion 361U. The protective layer 32 constructs a part of a surface of the projection 36U, facilitating sliding of the fixing belt 20 over the heater 22U and reducing friction between the fixing belt 20 and the heater 22U.

According to the embodiments described above, the projections 36, 36S, 36T, and 36U extend continuously in a longitudinal direction of the heaters 22, 22S, 22T, and 22U, respectively. Alternatively, a plurality of projections may be arranged in a longitudinal direction of a heater.

Referring to FIGS. 9A, 9B, 9C, and 9D, a description is provided of the construction of the heater 22V according to the fifth embodiment of the present disclosure.

Figure 9A:
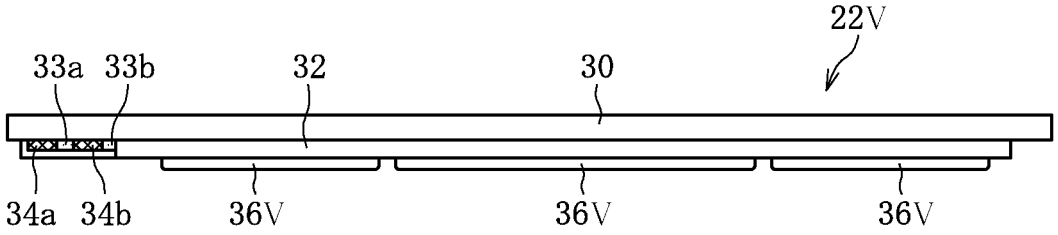
FIG. 9A is a plan view of a heater according to a fifth embodiment of the present disclosure, that is installable in the fixing device depicted in FIG. 2.
Figure 9B:
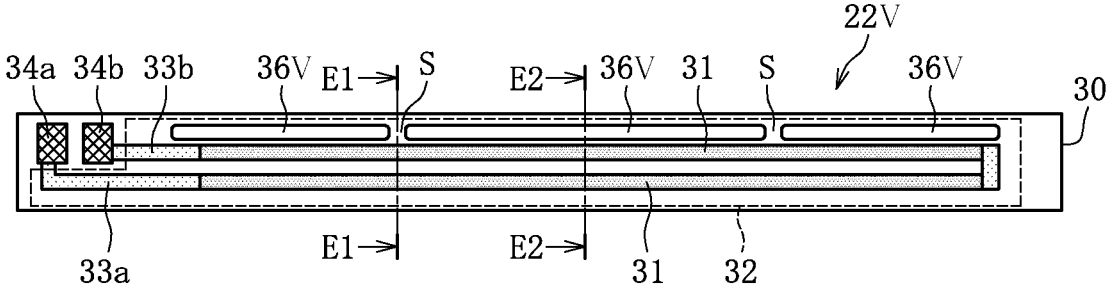
FIG. 9B is a front view of the heater depicted in FIG. 9A.
Figure 9C:
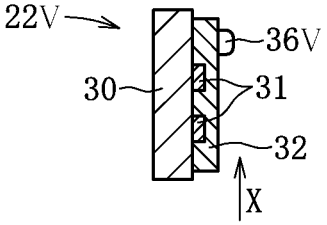
FIG. 9C is a cross-sectional view of the heater depicted in FIG. 9B taken on line E1-E1 in FIG. 9B.
Figure 9D:
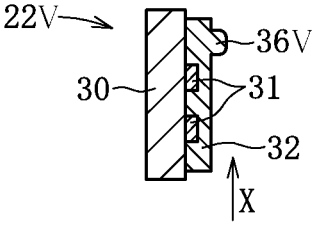
FIG. 9D is a cross-sectional view of the heater depicted in FIG. 9B taken on line E2-E2 in FIG. 9B.

FIG. 9C is a cross-sectional view of the heater 22V taken on line E1-E1 in FIG. 9B. FIG. 9D is a cross-sectional view of the heater 22V taken on line E2-E2 in FIG. 9B. As illustrated in FIGS. 9A, 9B, 9C, and 9D, the heater 22V according to the fifth embodiment includes three projections 36V arranged in a longitudinal direction of the heater 22V.

In order to reduce friction between the fixing belt 20 and the heater 22V and facilitate smooth rotation of the fixing belt 20, a lubricant such as grease is interposed between the fixing belt 20 and the heater 22V. According to this embodiment, a gap S is provided between adjacent ones of the projections 36V arranged in the longitudinal direction of the heater 22V. The lubricant moves through the gap S upward in FIG. 9B in a rotation direction of the fixing belt 20. Thus, the projections 36V do not clog the base 30 with the lubricant. The projections 36V are made of a pattern material that is equivalent to a pattern material of the resistive heat generators 31 and the like or made of a material that is different from a material of other elements of the heater 22V.

According to the embodiments described above, each of the projections 36, 36S, 36T, 36U, and 36V is disposed opposite or mounted on the downstream portion 30*a* of the base 30 that is disposed opposite the downstream portion of the fixing nip N in the sheet conveyance direction X. Alternatively, a projection may be disposed downstream from the fixing nip N in the sheet conveyance direction X as illustrated in FIG. 10. FIG. 10 is a schematic cross-sectional view of a fixing device 6W incorporating a heater 22W that includes a projection 36W disposed downstream from the fixing nip N in the sheet conveyance direction X. The projection 36W projects toward the pressure roller 21 at a position in a sheet conveyance path, that is disposed downstream from the fixing nip N in the sheet conveyance direction X, improving separation of the sheet P that has passed through the fixing nip N from the fixing belt 20.

The above describes examples according to the embodiments of the present disclosure in which the resistive heat generators 31 are mounted on the front face of the base 30, that faces the fixing belt 20 and the fixing nip N. Alternatively, the embodiments of the present disclosure are applicable to other configurations or constructions. For example, FIG. 11 illustrates a fixing device 6X incorporating the resistive heat generators 31 mounted on the back face of the base 30, that is opposite the front face of the base 30. The following describes projections according to the sixth to eighth embodiments, respectively, that are installed in heaters in which the resistive heat generators 31 are mounted on the back face of the base 30.

Referring to FIGS. 11, 12A, 12B, 12C, and 12D, a description is provided of the construction of the heater 22X according to the sixth embodiment of the present disclosure.

FIG. 12D is a cross-sectional view of the heater 22X taken on line F-F in FIG. 12C. As illustrated in FIGS. 11, 12A, 12B, 12C, and 12D, the heater 22X according to the sixth embodiment includes a back face protective layer 32X that is disposed on a back face 30*b* of the base 30 and covers the back face 30*b* of the base 30 and the resistive heat generators 31. A front face protective layer 37 is disposed on a front face 30*c* of the base 30.

The back face protective layer 32X and the front face protective layer 37 are preferably made of ceramic (e.g., alumina and aluminum nitride), glass, mica, or heat resistant resin (e.g., polyimide), which improves heat resistance and insulation of the back face protective layer 32X and the front face protective layer 37. The back face protective layer 32X protects and insulates the back face 30*b* of the base 30 and elements mounted on the back face 30*b* of the base 30 (e.g., the resistive heat generators 31 and the feeders 33*a*, 33*b*, and 33*c*). The front face protective layer 37 protects the front face 30*c* of the base 30, over which the fixing belt 20 slides.

The front face protective layer 37 includes a projection 36X disposed opposite the downstream portion 30*a* of the base 30 in the sheet conveyance direction X, that is, an upper portion of the base 30 in FIG. 12D.

Like the embodiments described above with reference to FIG. 2, if the projection 36X is disposed opposite the downstream portion of the fixing nip N in the sheet conveyance direction X, the projection 36X improves fixing performance of fixing the toner image on the sheet P. Like the embodiment described above with reference to FIG. 10, if the projection 36X is disposed downstream from the fixing nip N in the sheet conveyance direction X, the projection 36X improves separation of the sheet P from the fixing belt 20 after fixing.

Referring to FIG. 13, a description is provided of the construction of the heater 22Y according to the seventh embodiment of the present disclosure.

As illustrated in FIG. 13, the heater 22Y according to the seventh embodiment does not include a protective layer disposed on the front face 30*c* of the base 30 but does include the back face protective layer 32X disposed on the back face 30*b* of the base 30 and a projection 36Y that is disposed separately from the back face protective layer 32X. According to this embodiment, the projection 36Y is made of a pattern material that is equivalent to a pattern material of the resistive heat generators 31, the feeders 33*a*, 33*b*, and 33*c*, and the like or a material that is different from a material of elements of the heater 22Y.

Referring to FIG. 14, a description is provided of the construction of the heater 22Z according to the eighth embodiment of the present disclosure.

As illustrated in FIG. 14, the heater 22Z includes a projection 36Z constructed of a protrusion 361Z and a cover portion 362Z. The protrusion 361Z is produced as described above. The cover portion 362Z is a part of the front face protective layer 37, that covers the protrusion 361Z. The cover portion 362Z as a part of the front face protective layer 37 serves as a part of the projection 36Z and as a surface of the projection 36Z, facilitating sliding of the fixing belt 20 over the heater 22Z and reducing friction between the fixing belt 20 and the heater 22Z.

Next, a description is provided of a positional relation between the projection 36 having the configuration described above and a sheet in the longitudinal direction of the heater 22.

The following describes the positional relation with the construction in which the resistive heat generators 31 are mounted on the front face 30*c* of the base 30 as described above with reference to FIGS. 3A, 3B, and 3C as one example.

As illustrated in FIG. 15, a maximum sheet width W1 defines a width in the longitudinal direction of the heater 22 of a sheet P1 having a maximum width of a plurality of widths of sheets P that are conveyed through the fixing device 6. A maximum image width W2 defines a width in the longitudinal direction of the heater 22 of a maximum image formed on the sheet P1. According to this embodiment, a length of the projection 36 in the longitudinal direction of the heater 22 is not smaller than the maximum image width W2 and encompasses the maximum image width W2. According to this embodiment, as illustrated in FIG. 2, the projection 36 is disposed opposite the downstream portion of the fixing nip N in the sheet conveyance direction X. For example, if the sheets P conveyed through the fixing device 6 include a postcard, a B5 size sheet in landscape orientation, and an A4 size sheet in landscape orientation, the maximum width of the sheets P is a length of 297 mm of the A4 size sheet in landscape orientation in a longitudinal direction of the A4 size sheet.

According to this embodiment, since the projection 36 is disposed opposite the downstream portion of the fixing nip N in the sheet conveyance direction X, the projection 36 increases pressure applied to the sheet P throughout an entire image span on the sheet P at the fixing nip N, improving fixing performance of fixing the toner image on the sheet P throughout the entire image span in the axial direction of the fixing belt 20.

Referring to FIG. 16, a description is provided of an embodiment having a positional relation between the projection 36W having the configuration described above and a sheet in a longitudinal direction of the heater 22W, that is different from the embodiment depicted in FIG. 15.

As illustrated in FIG. 16, a length of the projection 36W in the longitudinal direction of the heater 22W is not smaller than the maximum sheet width W1 and encompasses the maximum sheet width W1. According to this embodiment, as illustrated in FIG. 10, the projection 36W is disposed downstream from the fixing nip N in the sheet conveyance direction X.

According to this embodiment, the projection 36W improves separation of the sheet P from the fixing belt 20 after fixing throughout an entire width of the sheet P in a width direction thereof parallel to the axial direction of the fixing belt 20.

The above describes the embodiments of the present disclosure. However, the technology of the present disclosure is not limited to the embodiments described above and is modified within the scope of the present disclosure.

The above-described definition that the projection 36 is disposed separately from the base 30 denotes that a separate member is attached to the base 30 by post processing, such as welding, adhesion, and screen printing described above, to produce the projection 36. Hence, the above-described definition that the projection 36 is disposed separately from the base 30 does not denote that a part of the base 30 is deformed by bending a metal plate by hemming, for example, to produce the projection 36. However, the base 30 and the projection 36 may not be made of different materials, respectively.

Alternatively, the image forming apparatus 1 according to the embodiments of the present disclosure depicted in FIG. 1 is not limited to a monochrome image forming apparatus that forms a monochrome toner image. For example, the image forming apparatus 1 may be a color image forming apparatus that forms a color toner image, a copier, a printer, a facsimile machine, a multifunction peripheral (MFP) having at least two of printing, copying, facsimile, scanning, and plotter functions, or the like.

The recording media include, in addition to plain paper as a sheet P, thick paper, a postcard, an envelope, thin paper, coated paper, art paper, tracing paper, an overhead projector (OHP) transparency, plastic film, prepreg, and copper foil.

The above describes examples according to the embodiments of the present disclosure in which a heater (e.g., the heaters 22, 22S, 22T, 22U, 22V, 22W, 22X, 22Y, and 22Z) is applied to a fixing device (e.g., the fixing devices 6, 6W, and 6X). Alternatively, the heater according to the embodiments of the present disclosure is also applicable to a heater installed in a dryer that dries a drying target. For example, the heater according to the embodiments of the present disclosure is also applicable to a dryer installed in an image forming apparatus employing an inkjet method. The dryer dries ink of an image formed on a surface of a recording medium such as a sheet.

According to the embodiments described above, the base 30 is made of an insulating material. Alternatively, the base 30 may be made of a conductive material. For example, as the conductive material, a material having an increased thermal conductivity, such as an iron based material (e.g., SUS stainless steel), aluminum, copper, silver, graphite, and graphene, is preferably used. The material having the increased thermal conductivity evens the temperature of an entirety of the heater by thermal conduction, improving quality of a toner image fixed on a sheet P. However, in this case, an insulating layer is interposed between the base 30 and the resistive heat generators 31 and between the base 30 and the feeders 33*a*, 33*b*, and 33*c*, and the like. As described above, according to the embodiments of the present disclosure, a definition that a heat generator (e.g., the resistive heat generators 31, 35, 35B, and 35C) and a projection (e.g., the projections 36, 36S, 36T, 36U, 36V, 36W, 36X, 36Y, and 36Z) are mounted on a base (e.g., the base 30) also denotes a configuration in which the heat generator and the projection are mounted on the base via an insulating layer or the like, in addition to a configuration in which the heat generator and the projection are mounted on the base directly.

The above describes examples according to the embodiments of the present disclosure in which the projection is a strip extending in a longitudinal direction of the heater as one example. Alternatively, for example, a plurality of projections, each of which has a decreased length, may be arranged in the longitudinal direction of the heater. The plurality of projections may be mounted on or disposed opposite a downstream portion of the base, that is disposed downstream from the fixing nip N in the sheet conveyance direction X.

A description is provided of advantages of a heater (e.g., the heaters 22, 22S, 22T, 22U, 22V, 22W, 22X, 22Y, and 22Z).

As illustrated in FIG. 2, the heater includes a base (e.g., the base 30), a heat generator (e.g., the resistive heat generators 31, 35, 35B, and 35C), and a projection (e.g., the projections 36, 36S, 36T, 36U, 36V, 36W, 36X, 36Y, and 36Z). The heat generator is mounted on the base. The projection is disposed separately from the base. The projection is disposed opposite or mounted on the base and disposed at a position different from a position of the heat generator. For example, the projection is shifted from the heat generator. In a state in which the heater is installed in a fixing device (e.g., the fixing devices 6, 6W, and 6X), the projection projects toward a fixing nip (e.g., the fixing nip N) of the fixing device. As illustrated in FIG. 3C, the projection is disposed opposite or mounted on a downstream portion (e.g., the downstream portion 30*a*) of the base in a recording medium conveyance direction (e.g., the sheet conveyance direction X).

Accordingly, the projection has a desired height.

According to the embodiments described above, the fixing belt 20 serves as a fixing rotator. Alternatively, a fixing film, a fixing sleeve, or the like may be used as a fixing rotator. Further, the pressure roller 21 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A heater installable in a fixing device having a fixing nip through which a recording medium is conveyed, the heater comprising:

a base including a downstream portion in a recording medium conveyance direction;

a heat generator mounted on the base;

a projection disposed separately from the base and shifted from the heat generator, the projection disposed opposite the downstream portion of the base, the projection configured to project toward the fixing nip in a state in which the heater is installed in the fixing device;

an electrode mounted on the base;

a protective layer configured to cover the base; and another projection arranged with the projection in a longitudinal direction of the heater with a gap between the projection and said another projection.

2. The heater according to claim 1, further comprising:

a center portion in the recording medium conveyance direction; and a downstream portion disposed downstream from the center portion in the recording medium conveyance direction, the downstream portion configured to protrude toward the fixing nip beyond the center portion.

3. The heater according to claim 1, wherein the projection is not electrically connected to the electrode.

4. The heater according to claim 1, wherein the protective layer includes at least a part of the projection.

5. The heater according to claim 1, further comprising a conductor configured to be electrically connected to the heat generator, wherein at least a part of the projection is made of a material equivalent to a material of the conductor.

6. The heater according to claim 1, wherein at least a part of the projection is made of a material equivalent to a material of the heat generator.

7. The heater according to claim 1, wherein at least a part of the projection is made of a material different from a material of each of the base and the heat generator.

8. The heater according to claim 1, wherein the projection includes:

a feeder mounted on the base and configured to couple the heat generator to the electrode; and a cover portion configured to cover the feeder, the cover portion included in the protective layer.

9. The heater according to claim 1, wherein the projection is disposed separately from the protective layer and is not electrically connected to the electrode.

10. A heater installable in a fixing device having a fixing nip through which a recording medium is conveyed, the heater comprising:

a base including a downstream portion in a recording medium conveyance direction;

a heat generator mounted on the base;

a projection disposed separately from the base and shifted from the heat generator, the projection disposed opposite the downstream portion of the base, the projection configured to project toward the fixing nip in a state in which the heater is installed in the fixing device;

an electrode mounted on the base; and a protective layer configured to cover the base, wherein the projection includes:

a protrusion mounted on the base and configured to be disconnected from the electrode; and a cover portion configured to cover the protrusion, the cover portion included in the protective layer.

11. A fixing device comprising:

a fixing rotator that is hollow and endless, the fixing rotator configured to rotate;

a pressure rotator configured to press against the fixing rotator to form a fixing nip between the fixing rotator and the pressure rotator, the fixing nip through which a recording medium bearing an image is conveyed; and a heater configured to contact an inner circumferential surface of the fixing rotator, the heater comprising:

a base including a downstream portion in a recording medium conveyance direction;

a heat generator mounted on the base; and a projection disposed separately from the base and shifted from the heat generator, the projection disposed opposite the downstream portion of the base, the projection configured to project toward the fixing nip in a state in which the heater is installed in the fixing device, wherein the base further includes:

a front face that faces the fixing rotator; and a back face that is opposite the front face and mounts the heat generator, wherein the heater further includes a back face protective layer disposed on the back face of the base and the heat generator, and wherein the projection is disposed separately from the back face protective layer.

12. The fixing device according to claim 11, wherein the projection is disposed opposite the fixing nip.

13. The fixing device according to claim 12, wherein the projection has a length in an axial direction of the fixing rotator, the length not smaller than an image width of the image on the recording medium in the axial direction of the fixing rotator.

14. The fixing device according to claim 11, wherein the projection is disposed downstream from the fixing nip in the recording medium conveyance direction.

15. The fixing device according to claim 14, wherein the projection has a length in an axial direction of the fixing rotator, the length not smaller than a maximum recording medium width of a plurality of widths of recording media that are conveyed through the fixing nip.

16. The fixing device according to claim 11, wherein the heater further includes a front face protective layer disposed on the front face of the base, the front face protective layer including the projection.

* * * * *